US006022481A

United States Patent [19]

Blake

[11] Patent Number: 6,022,481

[45] **Date of Patent: *Feb. 8, 2000**

[54] SINGLE PUMP POOL CLEANING SYSTEM AND METHOD OF SIMULTANEOUSLY OPERATING A FULL-FUNCTION SKIMMER AND MULTIPLE CLEANING HEADS

[75] Inventor: Andy F. Blake, Phoenix, Ariz.

[73] Assignee: Shasta Industries, Phoenix, Ariz.

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,307

[22] Filed: Sep. 11, 1996

[51] Int. Cl.[7] ..... E04H 4/12; E04H 4/16

[52] U.S. Cl. ..... 210/776; 210/805; 210/169; 210/416.2; 210/196; 4/490; 4/507; 4/509; 15/1.7

[58] Field of Search ..... 210/169, 776, 210/416.2, 805, 196, 232, 194; 4/490, 507, 509; 15/1.7

[56] References Cited

U.S. PATENT DOCUMENTS

| | | | |
|---|---|---|---|
| 4,322,860 | 4/1982 | Gould | 4/490 |
| 4,501,659 | 2/1985 | Henk | 210/169 |
| 4,523,606 | 6/1985 | Gould et al. | 137/119 |
| 5,505,844 | 4/1996 | Porter | 210/169 |
| 5,605,622 | 2/1997 | Ferraro | 210/169 |
| 5,725,761 | 3/1998 | Phillips | 210/169 |
| 5,750,022 | 5/1998 | Blake et al. | 210/169 |
| 5,753,112 | 5/1998 | Barnes | 210/169 |

*Primary Examiner*—Robert J. Popovics
*Attorney, Agent, or Firm*—Cahill, Sutton & Thomas P.L.C.

[57] ABSTRACT

A swimming pool cleaning system includes a pump, a first tube coupling a suction port of the pump in fluid communication with a main drain or mobile cleaning device which draws water and settled debris from the bottom of the pool, and a skimming device including an entrainment nozzle. The entrainment nozzle is coupled by a second tube to a coupling device which diverts a small portion of pool return water pumped from an outlet port of the pump. Most of the pool return water is pumped into a rotary distribution valve, various outlets of which are connected to various pool cleaning heads embedded in an inner surface of the pool. A vacuum canister having a removable cover to allow access to a removable debris trap disposed in the vacuum canister between an inlet and an outlet thereof is coupled between a suction inlet of the pump and the main drain or mobile cleaning device. A single low-horsepower pump produces simultaneous effective skimming, operation of embedded cleaning heads, and trapping of debris in a trap in a vacuum canister.

18 Claims, 5 Drawing Sheets

FIG. 4A
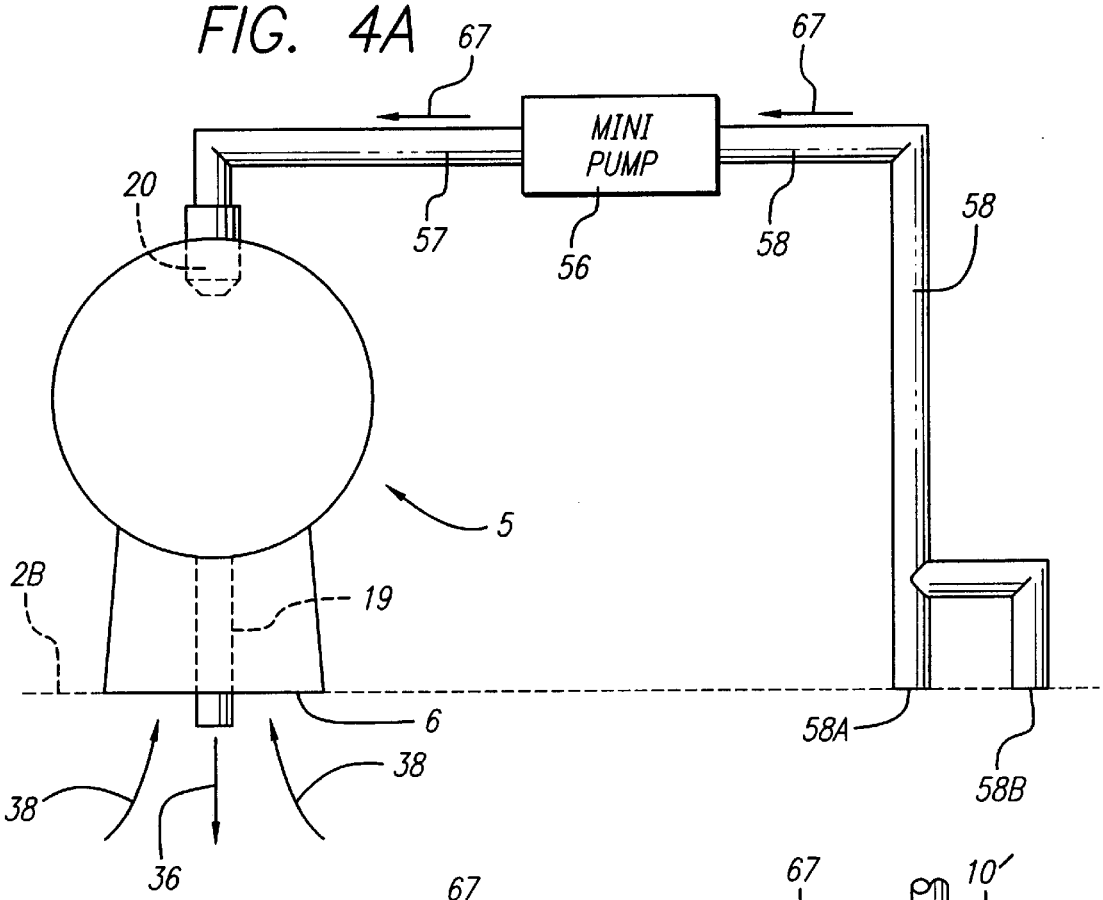
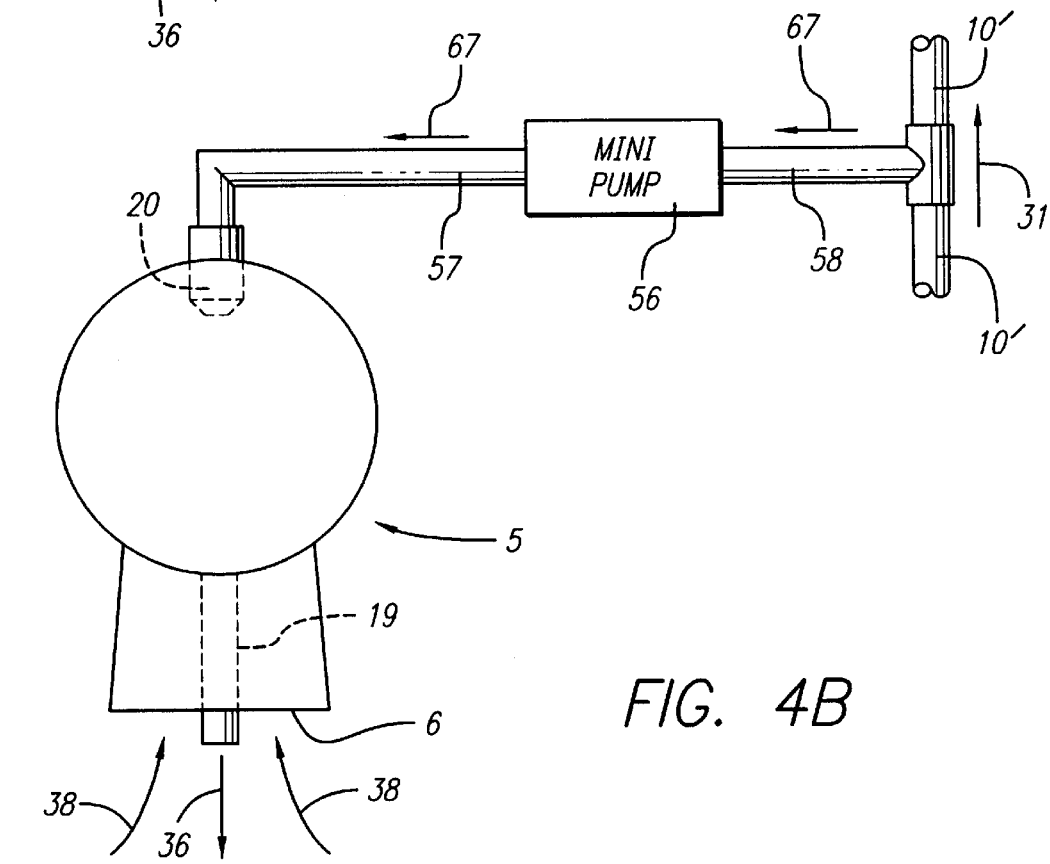
FIG. 4B

SINGLE PUMP POOL CLEANING SYSTEM AND METHOD OF SIMULTANEOUSLY OPERATING A FULL-FUNCTION SKIMMER AND MULTIPLE CLEANING HEADS

BACKGROUND OF THE INVENTION

The invention relates to a swimming pool cleaning system in which a single pool pump drawing water only out of a main drain can simultaneously operate a skimmer, a leaf and debris trap device in the suction line, and a plurality of pop-up cleaning heads disposed in floor and/or wall of the swimming pool.

Intense summer wind/dust storms are common in various parts of the country, especially the Southwest desert regions, wherein large amounts of leaves, dust, and other debris are deposited in swimming pools, presenting a burdensome cleaning problem. Some known pool cleaning systems agitate the water to keep dust and debris in suspension in the pool water so that the dust and debris are removed by the main pool filter. However, large debris blown into the pool by the intense summer wind/dust storms does not stay in suspension long enough to be filtered and instead settles to the bottom of the pool.

Typical well known components of a swimming pool cleaning system are disclosed in commonly assigned U.S. Pat. NO. 4,322,860 "POOL CLEANING HEAD WITH ROTARY POP-UP JET PRODUCING ELEMENT", by Henry D. Gould, issued Apr. 6, 1982, which discloses indexed rotation pop-up cleaning heads for installation in the bottom surfaces of a swimming pool, and U.S. Pat. NO. 4,523,606 "DISTRIBUTION VALVE", by Charles M. Gould and Andy F. Blake, issued Jun. 18, 1985, which discloses a rotary distribution valve that sequentially distributes water from the high pressure outlet of a swimming pool pump/filter system into the various pop-up cleaning heads. Commonly assigned allowed application "VACUUM SYSTEM FOR REMOVAL OF DEBRIS FROM SWIMMING POOLS", Blake et al., filed Nov. 29, 1995, Ser. No. 08/564,779 (U.S. Pat. No. 5,750,022), incorporated herein by reference, discloses a vacuum chamber having an access port, an outlet port connected to a suction inlet of the pump and an inlet port connected to receive water and debris pumped from the bottom of the pool. The above mentioned commonly assigned U.S. Pat. Nos. 4,322,860 and 4,523,606 also are incorporated herein by reference.

Another known system is described in the commonly assigned abandoned patent application "VACUUM-BOOSTED AUXILIARY SWIMMING POOL DRAIN/FILTER SYSTEM", Blake et al., filed Jan. 13, 1992, Ser. No. 07/821,393, incorporated herein by reference, and marketed by the Assignee as its QDR (Quick Debris Removal) system. That system is similar to the LEAF TRAPPER settled debris removal system marketed by Caretaker Systems, Inc., of U.S. Pat. No. 4,501,659 entitled "SKIMMER APPARATUS FOR SWIMMING POOLS" by Charles R. Henk, issued Feb. 26, 1985, discloses a skimmer in which all of the water returned by the pool pump through the filter to the pool is injected through a venturi or entrainment nozzle into the lower portion of a skimmer chamber. The water ejected by the entrainment nozzle entrains adjacent water in the skimmer body and carries such water through a return tube back into the swimming pool. Such entrainment causes surface water of the pool to flow by action of gravity into the skimmer to replace the entrained water.

The skimmer device described in the Henk patent was marketed by Hayward, Inc. for use in pools in which a bottom port of the skimmer shown by reference numeral 12 in FIG. 7 of the Henk patent housing was connected by a pipe to the suction side of an auxiliary swimming pool pump. The Hayward skimmer was marketed for the purpose of using only its suction port for "normal" skimming, and supplementing such normal skimming in a "turbo" mode by directing all of the return water into the entrainment nozzle when extra skimming was needed. The total amount of water drawn into the skimming inlet of the Hayward skimmer when in its "turbo" mode, was equal to the amount of water drawn by the auxiliary pump from the bottom of the skimmer plus the water entrained by the entrainment nozzle and carried out of the return tube along with the pumped water. The amount of pumped water typically was in the range from 60 to 100 gallons per minute. To achieve simultaneous skimming and operation of pop-up cleaning heads, an additional auxiliary pump would have been needed just for the Hayward skimmer. This is thought to have been the main reason for the very poor market acceptance of the Hayward skimmer.

It should be appreciated that an owner of a swimming pool having therein even the most effective commercially available automatic cleaning system occasionally may wish to use a conventional manual pool vacuum sweeper to manually vacuum the bottom of the swimming pool and thereby remove accumulated debris such as sand, gravel, leaves or the like more thoroughly and more quickly than can be accomplished by the automatic cleaning system. A conventional manual pool vacuum sweeper includes a long flexible hose coupled to a suitable suction port in the pool water recirculation system. Note that some settled debris, such as sand or gravel, may be too heavy to be effectively moved by the cleaning head jets to move it to the main drain. Or, the debris may be too large to pass into the main drain and hence into the strainers or filters of the pool cleaning systems.

In all known swimming pool cleaning systems, water drawn through a manual pool vacuum sweeper and into a suction port of the pool cleaning system passes through the main pump and main filter. The amount of flow of such "vacuumed" water is limited by the capacity of the main pump. It would be desirable to provide a manual vacuuming capability in an automatic pool cleaning system which exceeds the debris holding capacity of the "hair and lint basket" of the main pump. It also would be desirable to avoid damage to the pump impeller by heavy debris which is manually "vacuumed" from the bottom of the pool in the manner described above.

Until the present invention, there was no available "integrated" swimming pool cleaning system using only a single low horsepower pump (eg., one horsepower) to simultaneously provide the combination of good skimming, effective operation of pop-up cleaning heads embedded in the bottom and/or side walls and/or steps of the swimming pool, and removal and trapping of leaves and debris from the bottom of the swimming pool, either through a main drain or a mobile robotic cleaning device which moved along the bottom of the swimming pool. Although such a system would be highly desirable, and in fact for years there has been a great deal of motivation in the swimming pool/accessories industry to provide such a system at a reasonably low installation cost and having reasonably low operating and maintenance costs, that need has not been met prior to the present invention.

Note that in prior pool cleaning systems for large pools in which multiple skimmers were desired, suction provided by a single low horsepower pump had to be divided among the multiple skimmers, and the result usually was that adequate skimming could not be simultaneously achieved by all of the skimmers from the suction provided by the single pump.

SUMMARY OF THE INVENTION

Accordingly, it is an object of the invention to provide an improved skimming system for a swimming pool to provide effective skimming that is at least as effective as the system described in U.S. Pat. No. 4,501,659 by Henk while using only a small portion of the full pumping capability of a single conventional swimming pool pump.

It is another object of the invention to provide an integrated swimming pool cleaning system which, with only a single swimming pool pump, can simultaneously efficiently operate a skimmer, a plurality of pop-up cleaning heads in sequence, and a leaf debris removal device which traps leaves and debris which have settled to the bottom surface of a swimming pool.

It is another object of the invention to provide an integrated swimming pool cleaning system which can accommodate a manual pool vacuum sweeping device wherein debris swept from the bottom of the pool does not pass through the main pump.

Briefly described, and in accordance with one embodiment thereof, the invention provides a swimming pool cleaning system including a pump, a first tube coupling a suction port of the pump in fluid communication with a main drain or mobile cleaning device which draws water and settled debris from the bottom of the pool, and a skimming device including an entrainment nozzle. The entrainment nozzle is coupled by a second tube to a coupling device which diverts a small portion of pool "return" water pumped from an outlet port of the pump. In the described embodiment, most of the pool return water is pumped into a rotary distribution valve, the outlet ports of which are connected to various pool cleaning heads embedded in an inner surface of the pool. In the described embodiment, a vacuum canister having a removable cover to allow access to a removable debris trap disposed therein between an inlet and an outlet thereof is coupled between a suction inlet of the pump and the main drain or mobile cleaning device.

BRIEF DESCRIPTION OF THE DRAWINGS

FIG. 4A is a top view diagram illustrating an alternate embodiment of the invention utilizing a mini-pump to operate skimmer 5.

FIG. 4B is a top view diagram illustrating another alternative embodiment of the invention using a separate mini-pump to operate skimmer 5.

DETAILED DESCRIPTION OF THE PREFERRED EMBODIMENTS

Figure 1:
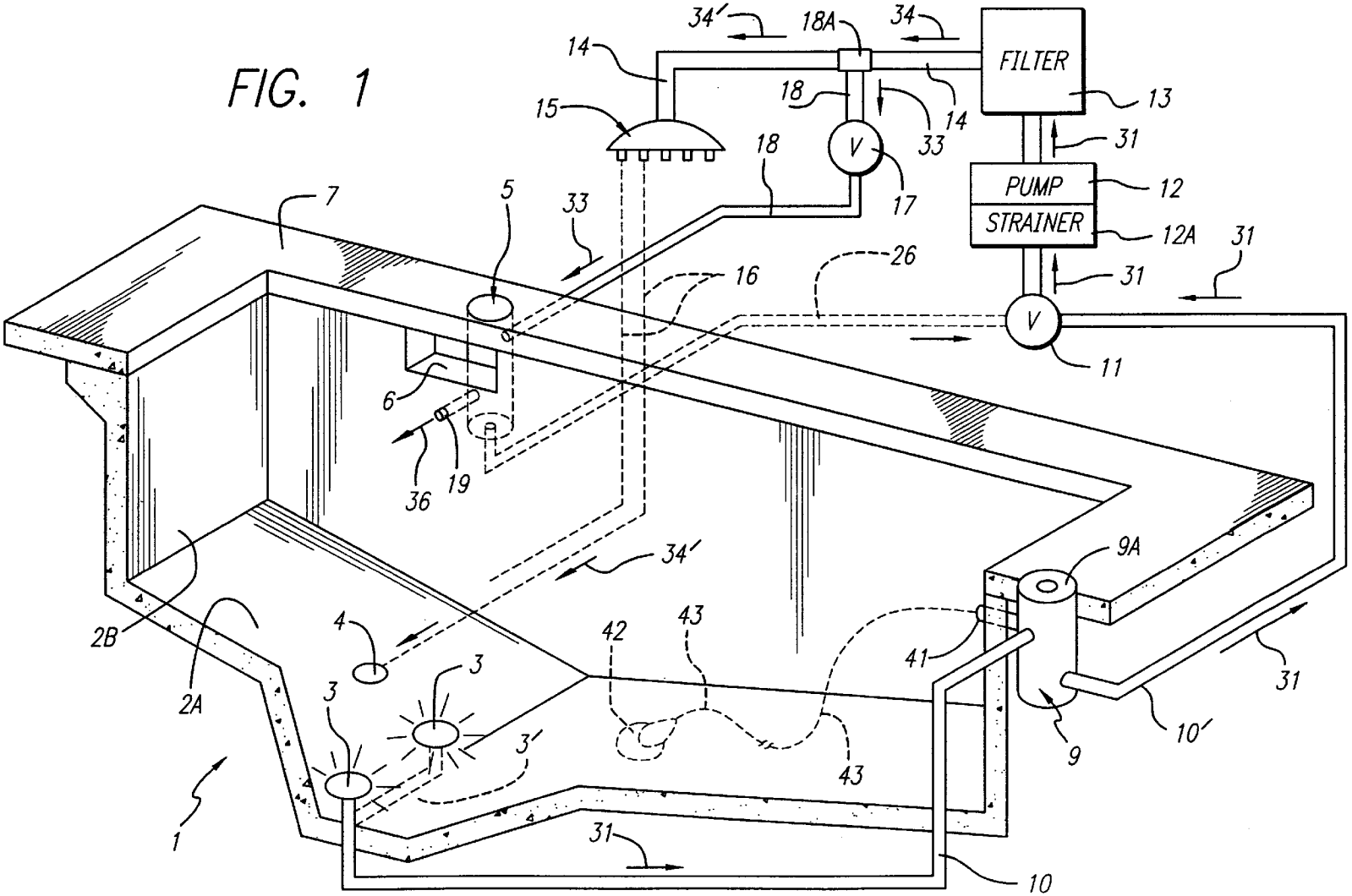
FIG. 1 is a partial perspective view illustrating the integrated swimming pool cleaning system of the present invention.
Figure 1A:
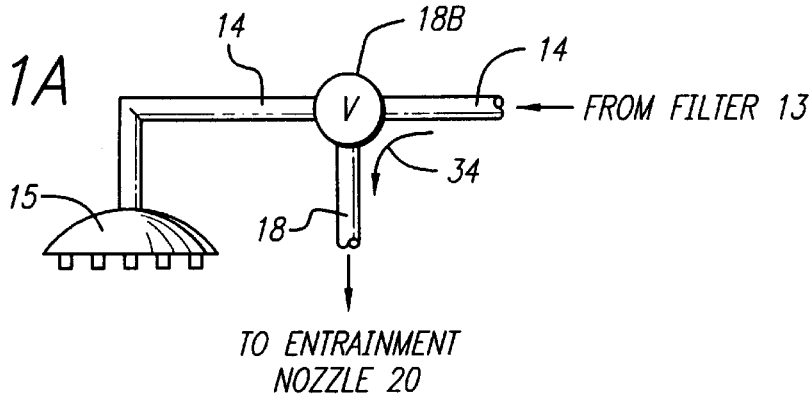
FIG. 1A is a diagram illustrating a modification to the embodiment of FIG. 1 in which a three way valve is substituted for the T-Connector 18A.

Referring now to the drawings, swimming pool 1, which includes a bottom 2A and inner walls 2B surrounded by a conventional pool deck 7, further includes an integrated pool cleaning system. The pool cleaning system may include a conventional one horsepower pump 12 having its high pressure outlet coupled to the inlet of a filter 13. The outlet of filter 13 is connected by a tube 14 to an inlet of a rotary distribution valve 15 of the type described in above referenced U.S Pat. No. 4,523,606, the various distribution outlet ports of which are each connected to one or more pop-up heads 4 disposed in the bottom 2A of the swimming pool. For convenience, only one connection between a distribution outlet of distribution valve 15 is shown, and is indicated by dotted line 16.

The suction inlet of pump 12 is connected by a tube 10', a vacuum canister 9, and a tube 10 to a pair of main drains 3 located in the lowest portion of pool bottom 2A. Vacuum canister 9 is connected between tubes 10 and 10'. Main drains 3 are separated by several feet and coupled by a balance tube 3' to prevent vacuum entrapment of a person against the bottom 2A of the pool. A removable porous trap 45 (FIG. 3) is disposed between the inlet and outlet ports of vacuum chamber 9, which are connected to tubes 10 and 10', respectively. The removable porous trap 45 can be accessed through a removable cover 9A (which forms a vacuum seal with vacuum chamber 9), emptied, and placed back in canister 9. This leaf/debris trapping canister is described in detail in the above mentioned application Ser. No. 08/564,779 incorporated herein by reference.

Figure 2:
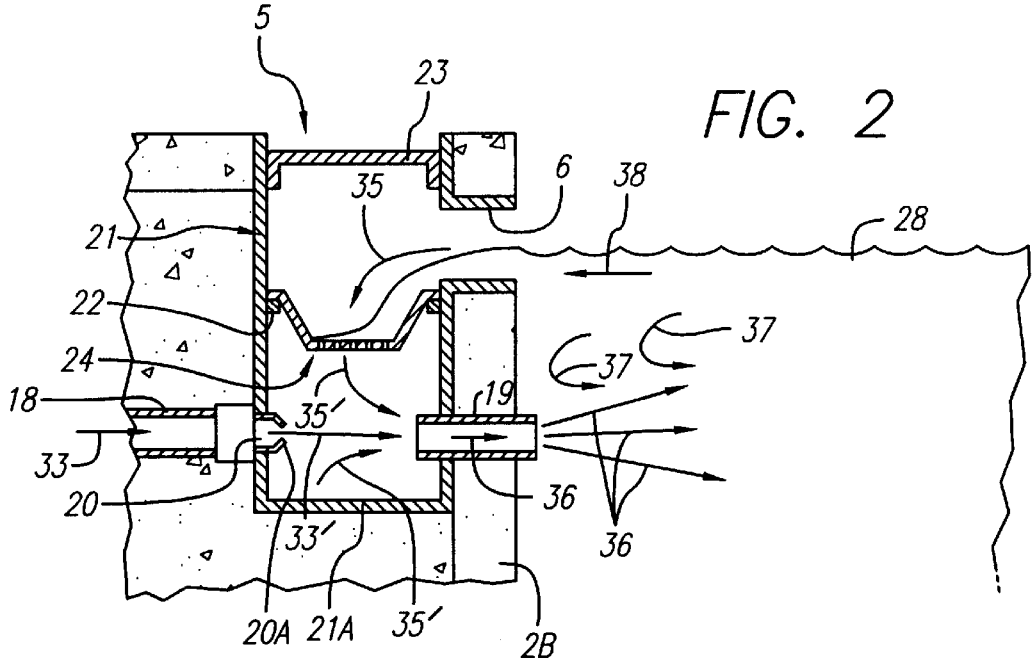
FIG. 2 is a section view diagram illustrating the skimmer of the system shown in FIG. 1.

Skimmer 5 includes a cylindrical body 21 (FIG. 2) having an inlet 6 that extends through vertical wall 2B and opens into the swimming pool so that water "skimmed" from the surface 28 of the swimming pool flows into the skimmer body 21. A suitable foranimous or porous basket or trap 24 has a circumferential upper lip that rests on a circumferential ledge 22 within body 21. A conventional removable lid 23 allows access to the inside of skimmer 5, so that debris trap 24 can be removed and emptied of floating debris which have been trapped or filtered from the skimmed water.

In accordance with the present invention, one end of a tube 18 is connected by a suitable coupler to an entrainment nozzle 20 that extends through the wall of skimmer body 21 below debris trap 24. The other end of tube 18 is connected by an optional on/off valve 17 and a Tee-connector 18A to above described tube 14. A portion 33 of the "return" water flow 34 from filter 13 is diverted as indicated into tube 18 and flows into entrainment nozzle 20. The remaining portion 34' of the return water flow 34 flows into rotary distribution valve 15 and the pop-up cleaning head or heads 4 connected to the presently selected outlet port of distribution valve 15. (In a typical system, each outlet port of distribution valve 15 feeds two or more pop-up cleaning heads 4, and all of the return water from the outlet of filter 13 except the diverted water through skimmer 5 passes through the presently selected outlet port of distribution valve 15 into the pop-up heads 4 connected to that port. Floor cleaning pop-up heads typically require 15–20 gallons per minute flow to be optimally effective. Step or bench cleaning heads typically require about 5 gallons per minute flow to be most effective)

The water jet 33' (FIG. 2) ejected by narrowed portion 20A of entrainment nozzle 20 is coaxially aligned with return tube 19, and and entrains "skimmed" water, i.e., pool surface water that has flown through inlet 6 into the lower portion of skimmer body 21, as indicated by arrows 35. The combination of return water 33' ejected from entrainment nozzle 20 and water entrained by the jet 33' is forced through return tube 19 and returned into the swimming pool as a diverging jet 36, which expands in diameter, and, if not deflected, may surface roughly 5–10 feet from skimmer 5, producing surface currents which move away from skimmer 5. The outlet of entrainment nozzle 20A can be 2–3 inches from the inlet of return tube 19.

FIG. 1 shows in dotted lines a suction tube 26 connected by optional valve 11 to the suction inlet of pump 12. Valve 11 allows part or all of the water pumped into the suction inlet of pump 12 to be diverted to tube 26. Suction tube 26 between skimmer 5 and pump 12 was provided in several experimental prototype swimming pool cleaning systems for testing purposes. Although suction tube 26 is unnecessary to the basic operativeness of the present invention, it is described herein both to explain an unexpected benefit of the present invention, and also to provide a useful alternate embodiment of the invention. Note also that tube 26 allows the pool owner to connect a hose to the port of tube 26 inside of skimmer 5 to manually "vacuum" the bottom of the pool, or to pass pool surface water drawn into the skimmer inlet 6 to be filtered by filter 13; this might be very desirable to remove oil or the like floating on the surface of the pool.

In the two prototype cleaning pool systems constructed according to the present invention, pump 12 is a one horsepower unit, and is capable of drawing roughly 60 to 100 gallons per minute of water (depending on the amount of water friction present in the particular pool plumbing) into its suction port, as indicated by arrows 31, through tubes 10 and 10', debris collection canister 9, and main drain 3. The amount of water recirculated by pump 12 depends mainly upon how much resistance-producing debris has accumulated in the porous filter element 45 in debris collection canister 9 and the amount of fluid resistance opposing "return" water from the outlet of filter 13 through the one or more pop-up cleaning heads 4 presently selected by rotary distribution valve 15.

In accordance with the present invention, only a small portion 33 (typically 5 to 10 gallons per minute) of the 60 to 100 gallons per minute of return water from the outlet of filter 13 is diverted through tube 18 into the entrainment nozzle 20 in skimmer 5. The preferred inside diameter of the outlet opening 20A of threaded, removable entrainment nozzle 20 is ¼ of an inch for the above indicated 5–10 gallon per minute diverted return flow. (A ⅝ inch inside diameter of portion 20A of entrainment nozzle 20 also is effective; a larger diameter entrainment nozzle may result in a greater amount of skimming than is really needed, at the cost of making the pop-up floor cleaning heads 4 ineffective by diverting too much of the flow 34 to the skimmer 5 so that not enough is available for cleaning heads 4.

In the two prototypes that have been constructed to date, return tube 19 is a 12 inch section of conventional 2 inch PVC pipe. If desired, a deflector (not shown) can be attached to the outlet of return tube 19 to change the recirculation pattern of water in the swimming pool and/or to prevent jet 36 from "surfacing". However, such a deflector will decrease the amount of water entrained.

It is believed that the above described skimmer, by using a large diameter, short return tube 19 with minimal flow restriction to create back pressure against the ejected jet 33' allows the relatively small 5–10 gallons per minute diverted flow 33 from the outlet of filter 13 to produce a jet 33' that entrains a very large amount of "adjacent" water in the lower part of skimmer body 21. This produces surface skimming action approximately as effective as that of the skimmer described in the Henk patent and marketed by Hayward, Inc, but using a far smaller portion of the pumped return water and without necessitating use of the full pumping capacity of a pump just to operate the skimmer. As a result, the large remaining portion 34' of the return water from pump 12 can be used for simultaneously operating pop-up cleaning heads 4 at essentially full efficiency.

The result is the least expensive, most easily maintained, lowest operating cost, fully integrated swimming pool cleaning system yet devised.

Although it is not well understood exactly how the jet 36 of water ejected from return tube 19 improves the skimming of floating debris, it is clear that jet 36 does enhance the skimming achieved by skimmer 5 compared to the skimming action that occurs if all of the "skimmed" water that flows by action of gravity through inlet 6 into body 21 of skimmer 5 replaces water drawn through the above described "optional" suction tube 26. In the experimental prototypes in which the suction tube 26 was provided for test purposes, if all of the water drawn into the suction inlet of pump 12 is diverted through tube 26 by valve 11 and valve 17 is turned off (so that none of the return water passes through entrainment nozzle 20) so that neither jet 33' nor jet 36 exists, then it was observed that the skimming of light floating debris that was deliberately scattered on the surface 28 of the pool water in the vicinity of skimmer 5 was actually less effective than was the case when the skimming resulted from the much smaller flow 33 through entrainment nozzle 20. This was observed to be the case even though the total amount of pool surface water entering body 21 through skimmer inlet 6 was roughly the same in each case.

As a possible explanation, it is thought that the jet 36 may improve skimming action by helping to set up surface currents in the swimming pool that tend to more effectively carry floating debris to the inlet of skimmer 5. It also is thought that jet 36 entrains some of the adjacent water through which jet 36 passes, as indicated by arrows 37 in FIG. 2. Such entrained water 37 then is replaced by flow that causes surface currents which in turn enhance the skimming. Observations have shown, surprisingly, that such surface currents cause nearby debris that are within roughly 12 inches of inlet 6 to be skimmed into inlet 6 much more effectively than is the case if all of the water drawn out of the bottom of skimmer body 21 is pumped through suction tube 26. Incidently, the effectiveness of a conventional swimming pool skimmer is known to be highest for floating debris that are located within a few inches (eg., 1–3 inches) from the mouth of the skimmer. The presence of ambient wind and/or swimming pool surface currents caused by the wind and/or swimming pool water circulation patterns established by the various water inlets and outlets of the pool while the pump is operating can carry the floating debris away from the mouth of the skimmer even though a large amount of pool water is being drawn into the inlet 6 of the skimmer. The water level within the skimmer is maintained at a lower level than the surface of the swimming pool by water being drawn out of the skimmer by a suction port on the bottom of the skimmer housing and/or by water that is entrained by return water being ejected from an entrainment nozzle and carried into tube 19 that returns entrained water and pumped return water back into the swimming pool below the surface.

Note that it is not essential that flow 31 be drawn from main drain 3. A suction port 41 on the vertical wall 2B of swimming pool 1 can be connected to the inlet of debris trapping canister 9. A long flexible hose indicated by dotted line 43 can be connected between suction port 41 and a "robotic" suction cleaning device 42, such as one marketed under the trademark KREEPY KRAWLEY. Even though such robotic suction cleaning devices are very effective at cleaning settled debris from the bottom of a swimming pool, it is very desirable to have effective simultaneous skimming to collect floating debris before it settles to the bottom.

Thus, the present invention provides efficient simultaneous skimming of the surface of a swimming pool without significantly reducing the suction applied via tube 10 to main drain 3 or via hose 43 to suction cleaning device 42 and without reducing the return flow needed for efficient simultaneous operation of cleaning heads 4. Both the pool water surface and the pool bottom are thereby kept clean, and the system is no more expensive to install, operate, and maintain than ordinary one-pump pool cleaning systems. Furthermore, with the present invention there is no longer a need for the pool owner to operate a valve to provide full suction from the single pump to the skimmer when a dust storm deposits a large amount of floating debris on the pool surface, and later operate the valve to switch full suction of the single pump to the main drain in the bottom of the pool to remove the large amount of debris that usually has settled to the bottom. Furthermore, the use of only the portion 33 of the return water (instead of suction from the skimmer through a tube such as 26) prevents the pump from loosing its prime and running dry (which damages pump seals and bearings) if the surface water level in the pool falls below the level of inlet 6.

The system of the present invention as shown in FIG. 1 typically could be powered by a 1 horsepower pump which, when connected as shown, produces a sufficient flow (e.g., approximately 90 GPM (gallons per minute) through the pump suction port. However, in the prior art QDR system, a larger (e.g., 1.5 horsepower) pump would be required to produce approximately the same 90 GPM flow through the suction port and filter because of greater friction loss resulting from the plumbing required for the QDR system. The system of FIG. 1 therefore circulates the pumped water efficiently as the QDR system (or LEAF TRAPPER system of Caretaker Systems, Inc.) with a lower cost pump and, significantly, considerably lower electricity cost.

Table 1 below illustrates how the efficiency of the embodiment of the invention shown in FIG. 1 compares to the most competitive prior automatic swimming pool cleaning system. That known prior system is referred to as the "QDR system", and is described in the above incorporated-by-reference patent application "VACUUM-BOOSTED AUXILIARY SWIMMING POOL DRAIN/FILTER SYSTEM". The QDR system further includes pop-up cleaning heads such as 4 in FIG. 1 hereof.

TABLE 1

| | Pump HP | Total Pump Return Flow | Settled Debris Removal Flow Through Auxiliary Drain | Portion of Return Flow Required for Skimming or Debris Removal | Portion of Return Flow Available to Cleaning Heads | Estimated Skimmed Surface Water Flow |
|---|---|---|---|---|---|---|
| FIG. 1 | 1 | 90 GPM | 90 GPM | 5–10 GPM | 80–85 GPM | 70 GPM |
| QDR System Including Cleaning Heads | 1.5 | 90 GPM | 50–60 GPM | 25–30 GPM | 60–65 GPM | 40 GPM |

As Table 1 shows, the system of FIG. 1 draws settled debris through the main drains 4 with a high flow rate of the full 90 GPM flow produced by main pump 12, whereas the QDR system and LEAF TRAPPER systems removed settled debris with a flow rate of 50 to 60 GPM. The system of FIG. 1 requires only 5 to 10 GPM to produce a surface water skimming rate of approximately 70 GPM, so 80 to 85 GPM of high pressure return flow to operate the cleaning heads 4 as available. This is in contrast with the QDR and LEAF TRAPPER systems, which require 25 to 30 GPM of high pressure return flow to the entrainment or venturi nozzle which produces the settled debris removal flow, leaving only 60 to 65 GPM of high pressure return water available to operate the cleaning heads. The estimated skimmed surface water flow rate in QDR systems is approximately 40 GPM.

Thus, although the system of FIG. 1 requires roughly a third less electrical power and a lower cost pump, it provides (1) much higher suction of settled debris through the main drain, (2) much higher flow of high pressure return water through the cleaning heads, and (3) better surface skimming, than the prior art QDR system.

Figure 3B:
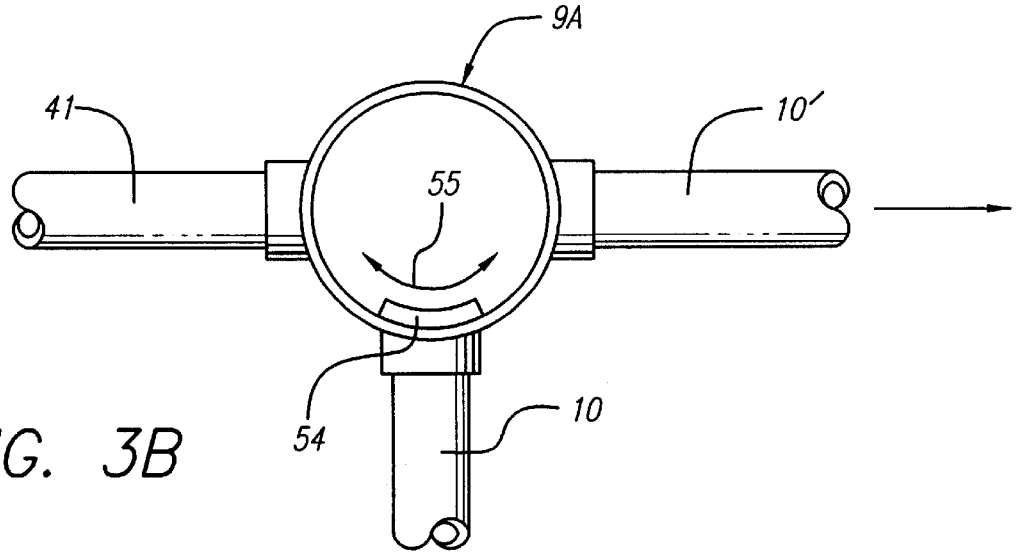
FIG. 3B illustrates an alternate connection of vacuum canister 9 to a vacuum port 41 and main drains 3.
Figure 3:
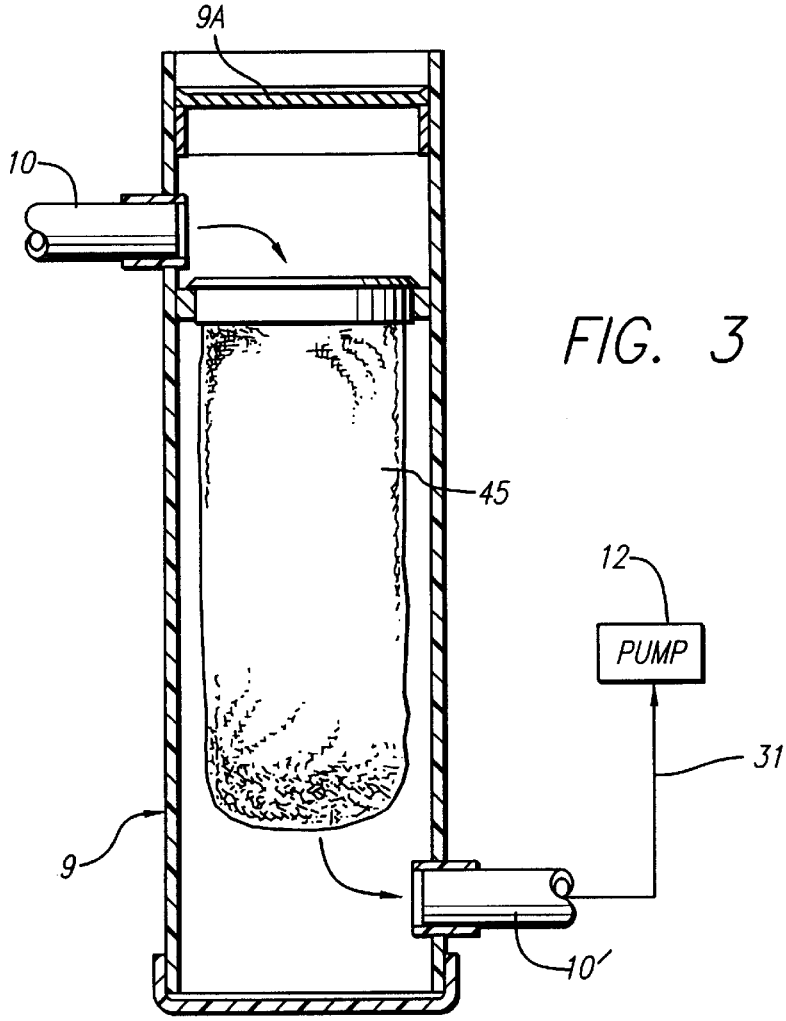
FIG. 3 is a section view of the debris trapping canister 9 of FIG. 1.
Figure 3A:
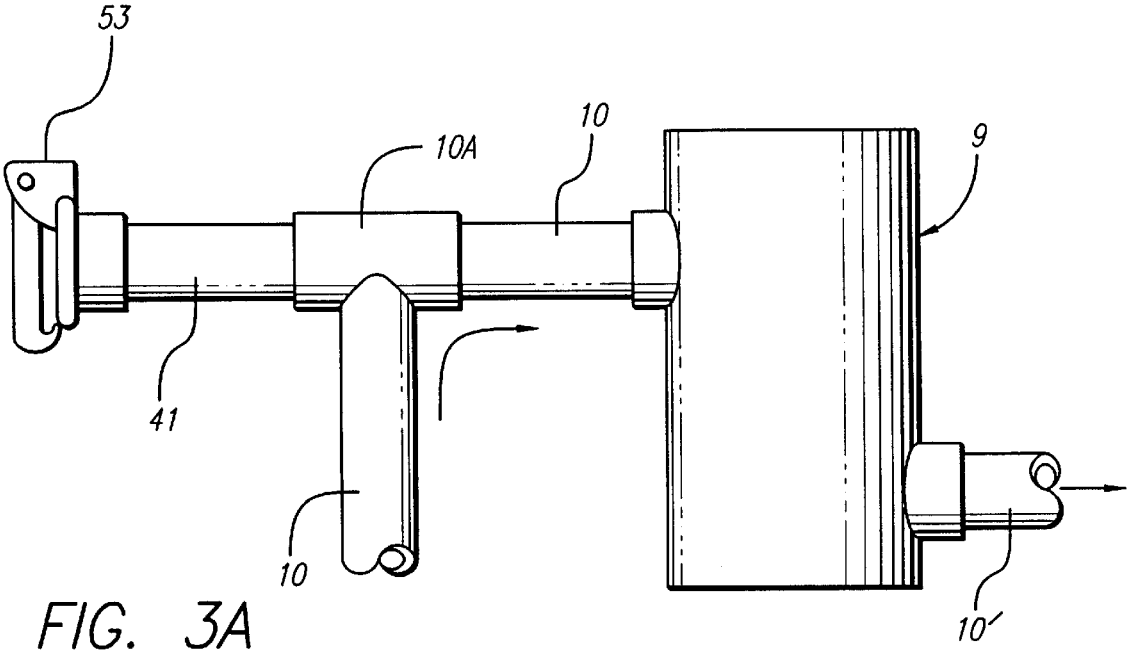
FIG. 3A is a partial section view illustrating connection of vacuum port 41 to vacuum canister 9 in FIG. 1.

FIG. 3A shows a conventional VAC LOCK cap 53 which is provided on the end of tube 41 (also see FIG. 1) to provide a vacuum-tight seal on the end of tube 41 if it is not being used as a vacuum port for connection to robotic cleaning device 42 or manual vacuum sweeping device 50. (This VAC LOCK device is described in U.S. Pat. No. 4,817,991.)

FIG. 3B shows an alternative embodiment of the invention in which vacuum canister 9 includes a moveable valve plate 54 which can be moved to block the flow of water from tube 10 into the interior of vacuum canister 9 if vacuum port 41 is being used. This allows the full suction produced by pump 12 to be applied to whatever robotic cleaning device or manual vacuum sweeping device is connected to vacuum port 41.

Figure 5:
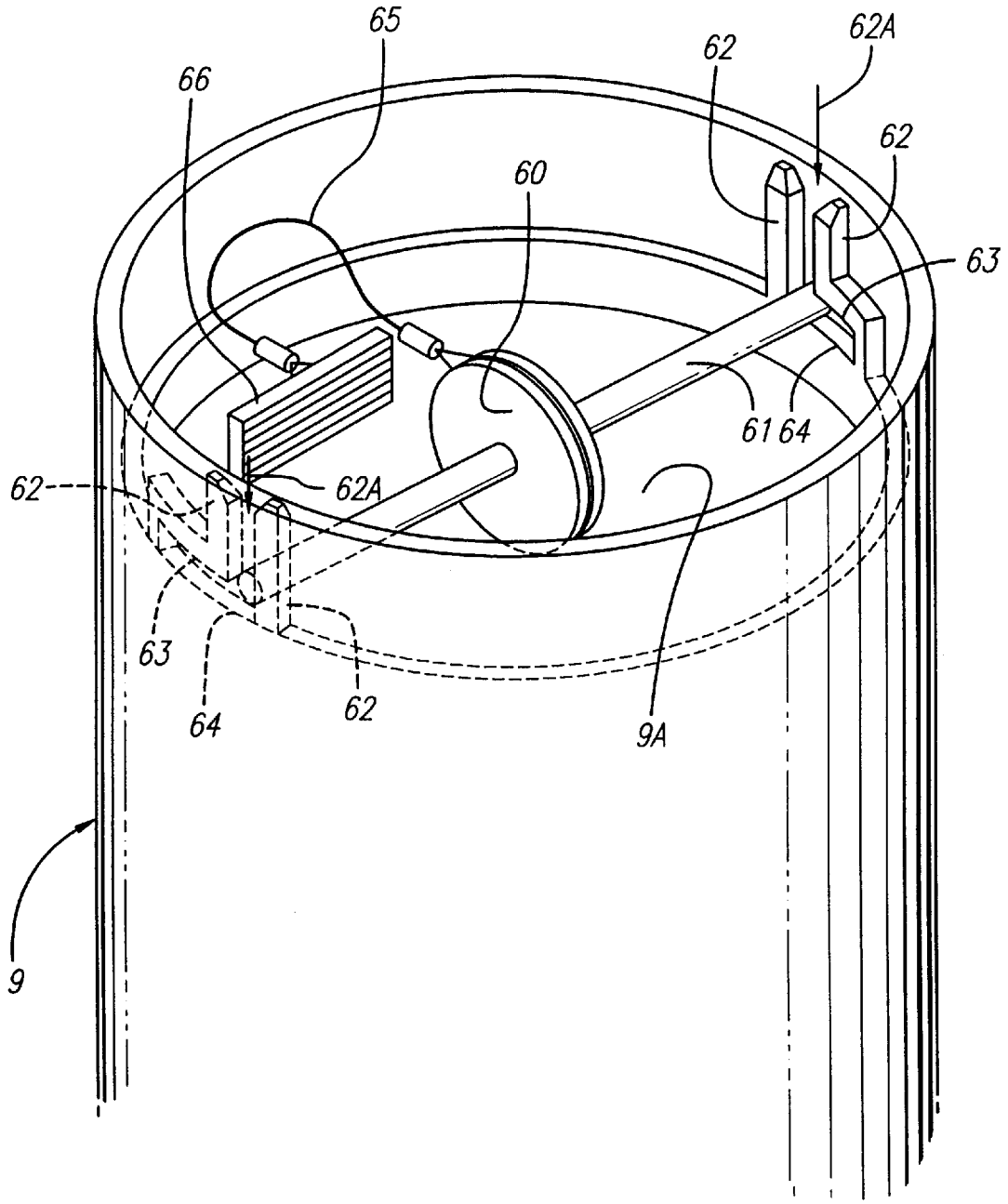
FIG. 5 is a perspective view illustrating a locking device to resist displacement of the lid of vacuum canister 9 due to "momentum hammering" of water in pipe 10.

FIG. 5 shows a locking device which can be used to effectively retain lid 9A on vacuum canister 9 so as to prevent lid 9A from being loosened by "momentum hammering" that may occur when pump 12 stops. The locking device 60,61 includes a steel bar 61 and a circular disk 60 axially mounted on the center of bar 61. Each of the opposed ends of bar 61 is lowered as indicated by arrow 62A into a vertical slot defined by stationary fingers 61 and 62. When both ends of rod 61 are lowered to bottoms of the vertical slots, rod 61 is rotated in the direction of arrows 64 so that the ends of rod 61 pass into a pair of stationary slots 63 which are slightly inclined relative to the plane of lid 9A. This forces the lowest point of disk 60 tightly against the upper surface of lid 9A, locking it tightly into place. A cable 65 connected between disk 60 and lid handle 66 prevents the locking device 60,61 from being inadvertently misplaced.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, since the described skimmer 5 requires only about 5–10 gallons per minute of the return water flow 34, one or more skimmers could be added if the pool were large, without excessively decreasing the flow 34' to the pop-up cleaning heads 4.

FIG. 4 illustrates an alternate embodiment of the invention utilizing a mini pump 56 to operate skimmer 5. The suction port of mini pump 56 is connected by tube 58 to draw water from the pool through inlets 58A and 58B in the wall 2B (See FIG. 1) of the pool. The pumped water 67 is pumped through tube 57 into the entrainment nozzle 20 of previously described skimmer 5. FIG. 4B illustrates another alternate embodiment in which the suction port of mini pump 56 is connected by tube 58 to a T-connector in tube 10' of FIG. 1, producing a flow 67 through tube 57 into entrainment nozzle 20 of previously described skimmer 5.

What is claimed is:

1. A pool cleaning system for a swimming pool, comprising in combination:

(a) a water recirculation system including a single pump having a suction port and an outlet port;

(b) a first tube coupling the suction port of the pump in fluid communication with an intake device which draws water and settled debris out of the swimming pool, water pumped out of the outlet port of the pump constituting pool return water;

(c) a skimming device including i. a hollow body having a skimming inlet and an open top, and a removable lid covering the open top to allow access to a first removable porous debris trap disposed in the body below the skimming inlet, ii. an entrainment nozzle in the body beneath the debris trap coupled in fluid communication with the outlet port, and iii. a return tube partly disposed in the body beneath the debris trap and extending through a wall of the body and positioned to receive a first jet of water ejected from the entrainment nozzle and water entrained by the first jet, to thereby remove water from the body of the skimming device and thereby cause gravity flow of pool surface water into the body through the skimming inlet;

(d) a coupling device receiving all of the return water from the outlet port of the pump and dividing all of the return water only into a first flow and a simultaneous second flow that is substantially less than the first flow and directing all of the second flow into the entrainment nozzle; and (e) a distribution valve having an inlet coupled to receive all of the first flow, the distribution valve having a plurality of outlet distribution ports coupled to a plurality of cleaning heads, respectively, the cleaning heads being embedded in an inner surface of the pool.

2. The pool cleaning system of claim 1 wherein the return tube ejects a second jet of water into the pool, the second jet creating back currents which enhance movement of surface water into the skimming inlet.

3. The pool cleaning system of claim 2 wherein the entrainment nozzle includes a narrowed ejection nozzle passage having an inside diameter of approximately ¼ of an inch coaxial with the return tube, the return tube being composed of an approximately 12 inch section of 2 inch PVC pipe.

4. The pool cleaning system of claim 3 wherein an outlet of the entrainment nozzle is approximately 2–3 inches from an inlet of the return tube.

5. The pool cleaning system of claim 1 wherein the pump pumps approximately 60 to 100 gallons per minute of pool water into its suction port, out of its outlet port, and through a filter, water exiting the filter being the pool return water, the coupling device diverting only approximately 5–10 gallons per minute of pool return water into the entrainment nozzle, the remaining pool return water flowing into the inlet of the distribution valve.

6. The pool cleaning system of claim 1 including a vacuum canister having an inlet coupled to a main drain of the swimming pool and an outlet coupled to the suction port of the pump, and a sealed lid that is removable to allow access to a second removable porous debris trap disposed in the vacuum canister between the inlet and outlet thereof.

7. The pool cleaning system of claim 1 wherein the intake device which draws water and settled debris from the bottom of the swimming pool includes a main drain of the swimming pool.

8. The pool cleaning system of claim 1 wherein the intake device which draws water and settled debris from the bottom of the swimming pool includes a mobile cleaning device which moves along the bottom of the swimming pool, the first tube including a flexible hose coupled to an outlet of the mobile cleaning device.

9. The pool cleaning system of claim 8 including a vacuum canister having an inlet coupled to the main drain and an outlet coupled to the suction port of the pump and a sealed lid that is removable to allow access to a second removable porous debris trap disposed in the vacuum canister between the inlet and outlet thereof, the flexible hose being coupled to the inlet of the canister.

10. A method of cleaning for a swimming pool, comprising the steps of:

(a) operating a water recirculation system including a single pump having a suction port and an outlet port, a first tube coupling the suction port in fluid communication with an intake device which draws water and settled debris from the bottom of the swimming pool, all of the water pumped out of the outlet port of the pump constituting pool return water;

(b) dividing all of the pool return water only into a first flow and a simultaneous second flow that is substantially less than the first flow;

(c) directing all of the second flow into an entrainment nozzle in a hollow body of a skimming device having a skimming inlet and an open top, a removable lid covering the open top to allow access to a first removable porous debris trap disposed in the body below the skimming inlet thereof, and a return tube partly disposed in the body beneath the debris trap and extending through the body to return pool water into the pool, the return tube being positioned to receive a first jet of return pool water ejected from the entrainment nozzle and surrounding pool water entrained by the ejected first jet to thereby remove water from the body and cause flow of water near the surface of the swimming pool to flow into the body through the skimming inlet; and (d) directing all of the first flow through various pop-up cleaning heads embedded in the inner surface of the swimming pool.

11. The method of claim 10 wherein the return tube ejects a second jet of water into the pool, the second jet creating back currents which enhance movement of surface water into the skimming inlet.

12. The method of claim 10 wherein step (a) includes drawing water from the bottom of the swimming pool through a vacuum canister having therein a second removable porous debris trap.

13. A pool cleaning system for a swimming pool, comprising in combination:

(a) a water recirculation system including a main pump having a suction port and an outlet port;

(b) a first tube coupling the suction port of the main pump in fluid communication with an intake device which draws water and settled debris out of the swimming pool, water pumped out of the outlet port of the main pump constituting pool return water;

(c) a skimming device including i. a hollow body having a skimming inlet and an open top, and a removable lid covering the open top to allow access to a first removable porous debris trap disposed in the body below the skimming inlet, ii. an entrainment nozzle in the body beneath the debris trap, and iii. a return tube partly disposed in the body beneath the debris trap and extending through a wall of the body and positioned to receive a first jet of water ejected from the entrainment nozzle and water entrained by the first jet, to thereby remove water from the body of the skimming device and thereby cause gravity flow of pool surface water into the body through the skimming inlet;

(d) a mini-pump coupled in fluid communication with the entrainment nozzle to produce the first jet, wherein the return tube ejects a second jet of water into the pool such that the second jet creates back currents which enhance movement of surface water into the skimming inlet;

(e) a distribution valve having an inlet coupled in fluid communication with the outlet port of the main pump to receive all of the return water therefrom, the distribution valve having a plurality of outlet distribution ports; and (f) a plurality of cleaning heads coupled to the outlet distribution ports, respectively, the cleaning heads being embedded in an inner surface of the pool, the pool cleaning system simultaneously skimming debris floating on the surface water and operating at least one of the cleaning heads.

14. A pool cleaning system for a swimming pool, comprising in combination:

(a) a water recirculation system including a single pump having a suction port and an outlet port;

(b) a vacuum canister having an inlet coupled to a drain of the pool and an outlet coupled to the suction port of the pump, and a sealed lid that is removable to allow access to a first removable porous debris trap disposed in the vacuum canister between the inlet and outlet thereof to collect large, settled debris drawn through the drain, water pumped out of the outlet port of the pump constituting return water;

(c) a skimming device including i. a hollow body having a skimming inlet and an open top, and a removable lid covering the open top to allow access to a second removable porous debris trap disposed in the body below the skimming inlet, ii. an entrainment nozzle in the body beneath the second debris trap coupled in fluid communication with the outlet port, and iii. a return tube partly disposed in the body beneath the debris trap and extending through a wall of the body and positioned to receive a first jet of water ejected from the entrainment nozzle and water entrained by the first jet, to thereby remove water from the body of the skimming device and thereby cause gravity flow of pool surface water into the body through the skimming inlet;

(d) a coupling device receiving all of the return water from the outlet port of the pump and dividing all of the return water only into a first flow and a simultaneous second flow that is substantially less than the first flow and directing all of the second flow into the entrainment nozzle;

(e) a distribution valve having an inlet coupled to receive all of the first flow, the distribution valve having a plurality of outlet distribution ports; and (f) a plurality of cleaning heads embedded in an inner surface of the pool, each outlet distribution port being coupled to at least one cleaning head, water pumped by the pump simultaneously skimming debris floating on the surface of the pool, operating at least one of the cleaning heads, and removing heavy settled debris.

15. The pool cleaning system of claim 14 wherein the pump pumps approximately 60 to 100 gallons per minute of pool water into its suction port, out of its outlet port, and through a filter, water exiting the filter being the pool return water, the coupling device diverting only approximately 5–10 gallons per minute of pool return water into the entrainment nozzle, the remaining pool return water flowing into the inlet of the distribution valve.

16. A pool cleaning system for a swimming pool including i. a single pump having a suction port and a high pressure port, ii. a first tube coupling the suction port to a main drain, iii. a distribution valve having an inlet port and adapted to sequentially distribute a stream of return water received through the inlet port through a plurality of outlet distribution ports of the distribution valve, and iv. a plurality of pop-up cleaning heads embedded in an inner surface of the pool and coupled to the various outlet distribution ports, respectively, the improvement comprising:

(a) a coupling device having an inlet port coupled to receive all of the return water pumped out of the high pressure port and dividing all of the return water into only a first flow out of a first outlet port of the coupling device and a simultaneous second flow out of a second outlet port of the coupling device such that the second flow is substantially less than the first flow;

(b) a second tube coupled between the first outlet port of the coupling device and the inlet port of the distribution valve to direct the first flow to the distribution valve;

(c) a venturi-powered skimmer having an inlet port for receiving return water from the high pressure port, a skimming inlet for receiving surface water skimmed from the pool, and an outlet port through which water entrained by means of an entrainment nozzle coupled to the inlet port of the venturi-powered skimmer is returned to the pool; and (d) a third tube coupled between the second outlet port of the coupling device and the inlet port of the venturi-powered skimmer to direct the second flow to the entrainment nozzle so the pump causes effective simultaneous (1) skimming of pool surface water, and (2) cleaning of the inner surface of the pool by the pop-up cleaning heads.

17. A pool cleaning system for a swimming pool including i. a single pump having a suction port and a high pressure port, ii. a first tube coupling the suction port to a main drain, iii. a distribution valve having an inlet port and adapted to sequentially distribute a stream of return water received through the inlet port through a plurality of outlet distribution ports of the distribution valve, and iv. a plurality of pop-up cleaning heads embedded in an inner surface of the pool and coupled to the various outlet distribution ports, respectively, the improvement comprising:

(a) a coupling device having an inlet port coupled to receive all of the return water pumped out of the high pressure port and dividing all of the return water into only a first flow out of a first outlet port of the coupling device and a simultaneous second flow out of a second outlet port of the coupling device such that the second flow is substantially less than the first flow;

(b) a second tube coupled between the first outlet port of the coupling device and the inlet port of the distribution valve to direct the first flow to the distribution valve;

(c) a venturi-powered skimmer having an inlet port for receiving return water from the high pressure port, a skimming inlet for receiving surface water skimmed from the pool, and an outlet port through which water entrained by means of an entrainment nozzle coupled to the inlet port of the venturi-powered skimmer is returned to the pool; and (d) a third tube coupled between the second outlet port of the coupling device and the inlet port of the venturi-powered skimmer to direct the second flow to the entrainment nozzle so the pump causes effective simultaneous (1) skimming of pool surface water, and (2) cleaning of the inner surface of the pool by the pop-up cleaning heads, wherein the pump draws approximately 60 to 100 gallons per minute of pool water into the suction port and pumps it out of the high pressure port and through a filter to the inlet port of the coupling device, the coupling device causing the second flow to be approximately 5–10 gallons per minute.

18. A pool cleaning system for a swimming pool including i. a single pump having a suction port and a high pressure port, ii. a first tube coupling the suction port to an outlet of a vacuum canister having an inlet coupled to a main drain of the pool, and a sealed lid that is removable to allow access to a removable porous debris trap disposed in the vacuum canister between the inlet and outlet thereof to collect large, settled debris drawn through the drain, iii. a distribution valve having an inlet port and adapted to sequentially distribute a stream of return water received through the inlet port through a plurality of outlet distribution ports of the distribution valve, and iv. a plurality of pop-up cleaning heads embedded in an inner surface of the pool and coupled to the various outlet distribution ports, respectively, the improvement comprising:

(a) a coupling device having an inlet port coupled to receive all of the return water pumped out of the high pressure port and dividing all of the return water into only a first flow out of a first outlet port of the coupling device and a simultaneous second flow out of a second outlet port of the coupling device such that the second flow is substantially less than the first flow;

(b) a second tube coupled between the first outlet port of the coupling device and the inlet port of the distribution valve to direct the first flow to the distribution valve;

(c) a venturi-powered skimmer having an inlet port for receiving return water from the high pressure port, a skimming inlet for receiving surface water skimmed from the pool, and an outlet port through which water entrained by means of an entrainment nozzle coupled to the inlet port of the venturi-powered skimmer is returned to the pool; and (d) a third tube coupled between the second outlet port of the coupling device and the inlet port of the venturi-powered skimmer to direct the second flow to the entrainment nozzle so the pump causes effective simultaneous (1) skimming of pool surface water, and (2) cleaning of the inner surface of the pool by the pop-up cleaning heads, wherein the pump draws approximately 60 to 100 gallons per minute of pool water into the suction port and pumps it out of the high pressure port and through a filter to the inlet port of the coupling device, the coupling device causing the second flow to be approximately 5–10 gallons per minute.

* * * * *